United States Patent [19]

Sheehan

[11] Patent Number: 4,831,757

[45] Date of Patent: May 23, 1989

[54] MINIATURE VORTEX GENERATING APPARATUS

[76] Inventor: Teddy J. Sheehan, P.O. Box 116, Eldorado, Okla. 73537

[21] Appl. No.: 96,988

[22] Filed: Sep. 16, 1987

[51] Int. Cl.[4] ..... G09F 19/00

[52] U.S. Cl. ..... 40/406; 40/427; 40/538

[58] Field of Search ..... 40/406, 409, 412, 427, 40/439, 538; 434/217; 366/601

[56] References Cited

U.S. PATENT DOCUMENTS

| | | | |
|---|---|---|---|
| 2,315,018 | 3/1943 | Lawrence | 366/601 |
| 3,299,226 | 1/1967 | Edwards | 366/601 |
| 3,589,044 | 6/1971 | Morrison | 434/217 |
| 3,589,603 | 6/1971 | Fohl | 239/11 |
| 3,940,060 | 2/1976 | Viets | 239/14 |
| 3,972,512 | 8/1976 | Grise et al. | 366/262 |
| 4,258,912 | 3/1981 | Reighart | 434/217 |
| 4,265,402 | 5/1981 | Tsai | 40/406 |

OTHER PUBLICATIONS

The Science Teacher * 9/15/64–p. 72–advertisement for Tornado Demonstrator.

*Primary Examiner*—Gene Mancene
*Assistant Examiner*—Wenceslao J. Contreras
*Attorney, Agent, or Firm*—Robert K. Rhea

[57] ABSTRACT

A toy apparatus for generating a captive vortex comprises an upright transparent cylindrical enclosure filled with a selected quantity of a liquid and gas. A vane, sleeve and disk assembly coaxially mounted on a motor drive shaft, extending axially into the enclosure through its lid, is angularly rotated by the motor in response to manually operated electrical controls connecting a source of electrical energy with the motor.

5 Claims, 1 Drawing Sheet

MINIATURE VORTEX GENERATING APPARATUS

BACKGROUND OF THE INVENTION

1. Field of the Invention

The present invention relates to vortex generating apparatus and more particularly to an apparatus for producing a captive vortex in a column of fluid.

The apparatus has particular application in advertising display to repeatedly produce a well defined vortex in a column of fluid. The device also has particular application in educational fields for research and study of the theory of atmospheric conditions necessary for the formation of tornados.

2. Description of the Prior Art

Prior patents disclose vortex producing apparatus for moving one fluid through another, such as U.S. Pat. No. 3,589,603, in which a pollutant bearing gas is transported to upper layers of the atmosphere through a vortex formed in the lower layers of the atmosphere.

U.S. Pat. No. 3,940,060 discloses apparatus for generating vortex rings in the atmosphere or through a cloud cover by heat for directing light beams through the void as an aid to pilots in locating an airport.

This invention is distinctive over these and other vortex generating patents by an upright fluid filled cylindrical container having a motor driving a vortex generator respectively mounted on and under the cylinder cap.

SUMMARY OF THE INVENTION

An upright cylindrical container is substantially filled with a quantity of liquid, such as water, and closed by a cap. The motor is mounted on the cap with its drive shaft projecting into the container and connected with a disk and vane assembly for angular rotating the latter and generating a vortex producing circular motion in a portion of the contained fluid. The entire assembly is preferably mounted in a housing having a door closed cylinder viewing window with the housing also supporting an electrical circuit and controls for illuminating the cylinder and driving the motor.

The principal object is to provide a vortex generating device in a liquid confined by a transparent container for amusement, educational or advertising purposes.

DESCRIPTION OF THE PREFERRED EMBODIMENTS

Figure 1:
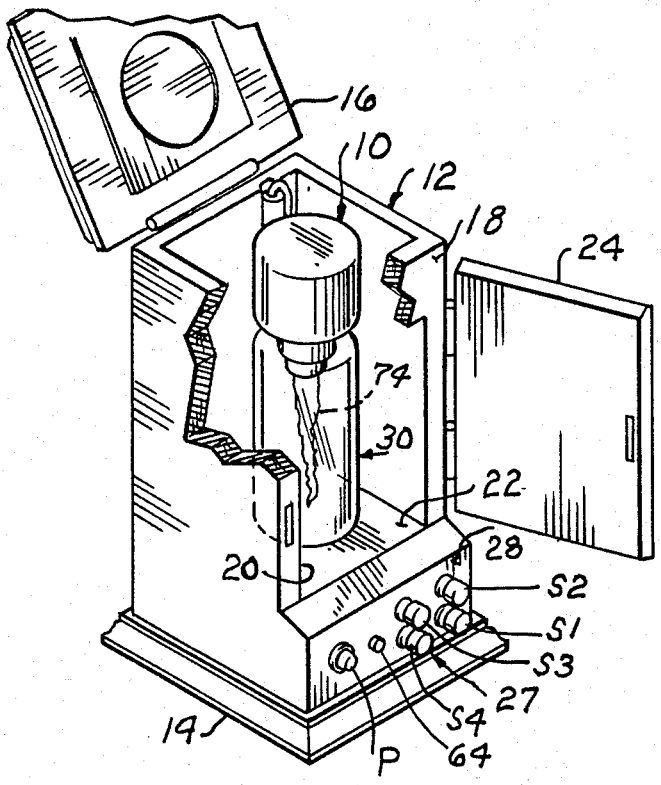
FIG. 1 is a fragmentary perspective view of the apparatus contained by its housing.
Figure 3:
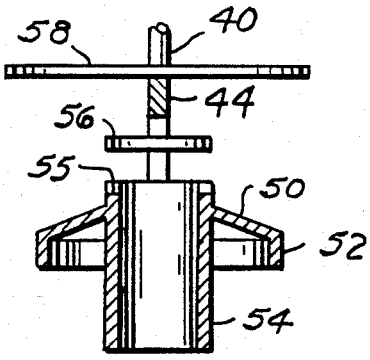
FIG. 3 is a vertical cross sectional view, to a further enlarged scale, taken substantially along the line 3—3 of FIG. 2.
Figure 4:
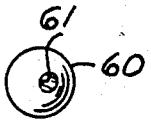
FIG. 4 is a perspective view of one of a plurality of spheres contained by the cylinder; and, FIG. 5 is a wiring diagram.
Figure 5:
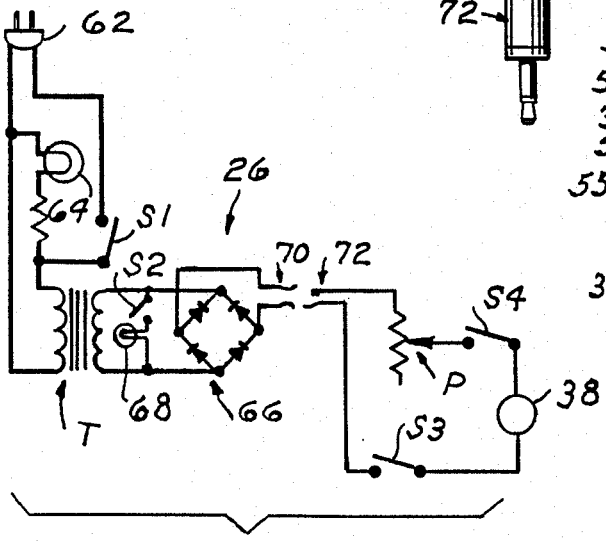
Figure 2:
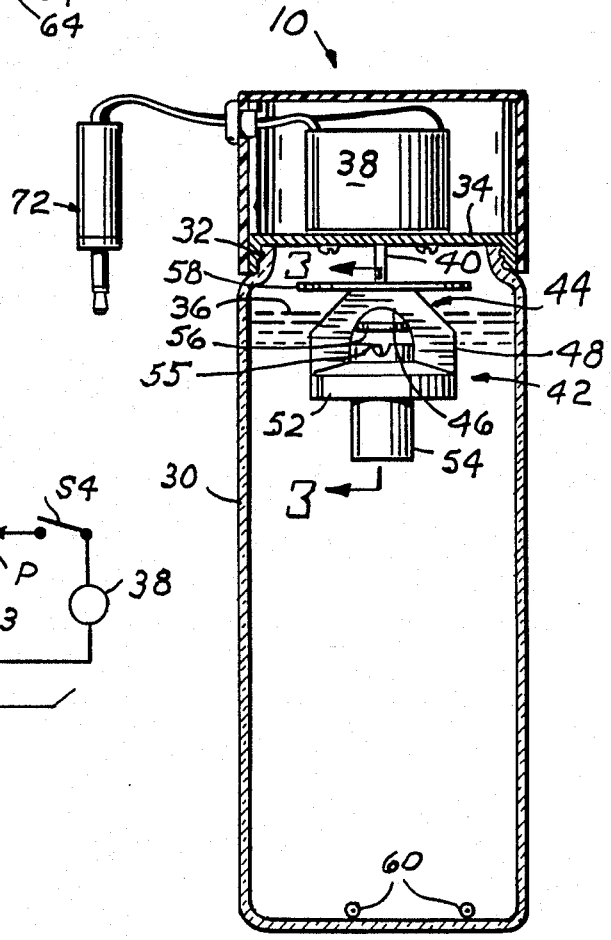
FIG. 2 is a vertical cross sectional view, to a larger scale, of the vortex generating apparatus, removed from its housing.

Like characters of reference designate like parts in those figures of the drawings in which they occur.

In the drawings:

The reference numeral 10 indicates the vortex generating apparatus which is upright cylindrical in general configuration and usually contained by a housing 12.

The housing 12 is of generally conventional construction comprising a base 14 with upstanding rectangular walls defining an open top normally closed by a lid 16. The housing front wall 18 is provided with an aperture 20 terminating in the plane of a housing false bottom 22 with the opening exposing the major depending end portion of the vortex generating apparatus 10. The housing front opening 20 is closed by a door 24 hingedly mounted to its front or an adjacent side wall for horizontal swinging movement.

The housing false bottom 22 defines the upper limit of a housing lower compartment containing an electrical circuit 26 for operating the apparatus by controls 27 mounted on a control panel 28 below the door 24, as presently explained.

The apparatus 10 comprises an upright cylindrical container or jar 30 preferably having threads 32 at its neck or upper end for threadedly receiving a cap 34 closing the cylinder. The cylinder 30 is substantially filled with a liquid, such as water 36. The area above the water contains air under atmospheric pressure.

A direct current variable speed motor 38 is centrally mounted on the top surface of the cap 34 with its drive shaft 40 projecting downwardly through the cap and supporting a vane and disk assembly 42.

The assembly 42 is disposed adjacent the upper limit of the fluid 36 and comprises a vertically disposed inverted U-shaped vane 44 of selected height defining an arcuate bight 46. The legs 48 of the U-shape are integrally joined diametrically to the top surface of an annular downward and outwardly inclined flange 50 having a central opening and terminating at its perimeter in a relatively short annular vertical flange or wall 52. The inner limit or opening of the inclined flange 50 surrounds and is integrally joined to the periphery of the top end portion of an open end sleeve 54 having a diametric U-shaped slot 55 formed in the upper end surface of its wall and normal to the plane of the vane. The major portion of the sleeve projects downwardly beyond the horizontal plane defined by lower limit of the vertical wall 52. The diameter of the wall 52 preferably being not greater than the radius of the cylinder 30 and the diameter of the sleeve 54 preferably being not greater than the radius of the wall 52. A first planar disk 56 is interposed between the vane legs 48 and between the upper limit of the sleeve 54 and the bight 46 of the vane. A second planar disk 58 coaxial with the drive shaft 40, having a diameter slightly greater than the diameter of the wall 52, is interposed between the drive shaft 40 and the U-shaped vane 44.

Tornados typically contain, at their depending end portion, a quantity of debris picked up by the tornadic winds and such debris is represented in this device by at least two plastic material spheres 60, having a density substantially greater than water and of relatively small diameter when compared to the diameter of the cylinder 30, each sphere having a relatively small diameter bore 61.

The circuit 26 includes a common electrical plug 62 for connection with a household electrical outlet, not shown. The plug is connected to the primary winding of a transformer T through an off-on switch S1 with a power "on" indicator, or lamp 64, energized by closing the normally open switch S1. The secondary winding of the transformer T1 is connected with a diode rectifier, such as a bridge rectifier 66. An apparatus illuminating lamp 68 bridges the secondary winding and is energized by a second switch S2. The direct current from the bridge 66 is connected with a telephone-type jack 70 for receiving a plug 72 which connects the positive and negative current to the motor 38 through a motor off-on switch S3 and a potentiometer P for controlling the speed of the motor 38. A second momentary off-on switch S4 is connected in series with the potentiometer.

Operation

In operation, the device is assembled as described hereinabove and with the plug 62 connected with an outlet, the switches S1 and S2 are closed. The motor switches S3 and S4 are then closed which angularly rotates the vortex generating assembly 42 in accordance with the setting of the potentiometer P. Rotation of the apparatus 42 induces horizontal circulation in the fluid 36 and with the air in the cylinder above the fluid simulates atmospheric conditions and generates an elongated substantially cone-shaped vortex configuration 74 (FIG. 1) within the fluid. Opening and closing the momentary switch S4 slowing and speeding up the motor generates the erratic forces present in tornadic winds and enhances generating a vortex. A little trial and error is usually necessary. The vortex extends from the angularly rotating assembly 42 to a point at or adjacent the inner bottom surface of the cylinder 30 with the plastic balls 60 in suspension near the depending end of the vortex. By manual adjustment of the potentiometer increasing or decreasing the speed of the motor 38, the vortex may be caused to increase and decrease in its intensity.

Obviously the invention is susceptible to changes or alterations without defeating its practicability. Therefore, I do not wish to be confined to the preferred embodiment shown in the drawings and described herein.

I claim:

1. Apparatus for producing a captive miniature conical vortex, comprising:

an upwardly open transparent enclosure of generally cylindrical configuration;

fluids substantially filling said enclosure;

cap means closing said enclosure;

means within the upper end portion of said enclosure including a vane assembly comprising an inverted U-shaped vane having spaced-apart legs and a sleeve secured at one end portion between and depending from the legs of the U-shaped vane defining an axial axis of rotation within the enclosure for inducing angular rotation of said fluids and defining a visible vortex in the central portion thereof; and, a motor mounted on said cap and drivably connected with the angular rotation inducing means.

2. Apparatus according to claim 1 in which the fluids comprise:

a quantity of a selected liquid filling the major portion of said enclosure; and, a gas filling the remainder of said enclosure.

3. The apparatus accordng to claim 2 in which the angular rotation inducing means further includes:

an inverted cup defined by an upward and inwardly converging wall coaxially surrounding and secured to said sleeve intermediate its ends and terminating downwardly in an annular wall loosely surrounding the sleeve; and at least one disk coaxially mounted on said vane assembly.

4. The apparatus according to claim 3 and further including:

manually operated controls including a circuit connecting a source of electrical energy with said motor, said circuit including a momentary off-on switch for varying the angular rate of rotation of said motor and vane assembly and generating fluid turbulence during the initial angular rotation thereof.

5. The apparatus according to claim 4 and further including:

debris simulating means in the fluids including a plurality of spherical members having a density greater than said fluids.

* * * * *